US005309684A

United States Patent [19]

Davidovici

[11] Patent Number: 5,309,684

[45] Date of Patent: May 10, 1994

[54] MULTIPURPOSE DRY STORAGE SYSTEM

[76] Inventor: Shmuel Davidovici, Rehov Oranim 43/A, Tivon 36000, Israel

[21] Appl. No.: 795,138

[22] Filed: Nov. 20, 1991

[51] Int. Cl.[5] ..... E04H 15/20

[52] U.S. Cl. ..... 52/2.17; 52/2.22; 52/2.18

[58] Field of Search ..... 135/102, 104, 115, 114; 52/2.17, 2.18, 2.19, 2.21, 2.22; 403/292

[56] References Cited

U.S. PATENT DOCUMENTS

| | | | |
|---|---|---|---|
| 2,055,044 | 9/1936 | Nelson | 135/104 |
| 2,345,377 | 3/1944 | Bowen | 135/104 |
| 3,240,217 | 3/1966 | Bird et al. | 52/2.17 X |
| 3,441,037 | 4/1969 | Transeau | 135/102 X |
| 3,970,096 | 7/1976 | Nicolai | 135/104 X |
| 4,012,867 | 3/1977 | Lainchbury et al. | 52/2.17 X |
| 4,269,210 | 5/1981 | Marks | 403/292 X |

*Primary Examiner*—Carl D. Friedman
*Assistant Examiner*—Lan C. Mai
*Attorney, Agent, or Firm*—Mark M. Friedman

[57] ABSTRACT

A dry storage unit for use in storing vehicles or other equipment for long periods of time, capable of being easily deployed and redeployed and enabling the vehicle or equipment to be readily placed into and taken out of storage. The storage unit includes a tubular member made of flexible material. The desired shape is imparted to the unit by semi-rigid support members which are kept in the proper orientation by a connection made up of two cylindrical sections placed one within the other.

9 Claims, 3 Drawing Sheets

FIG.7
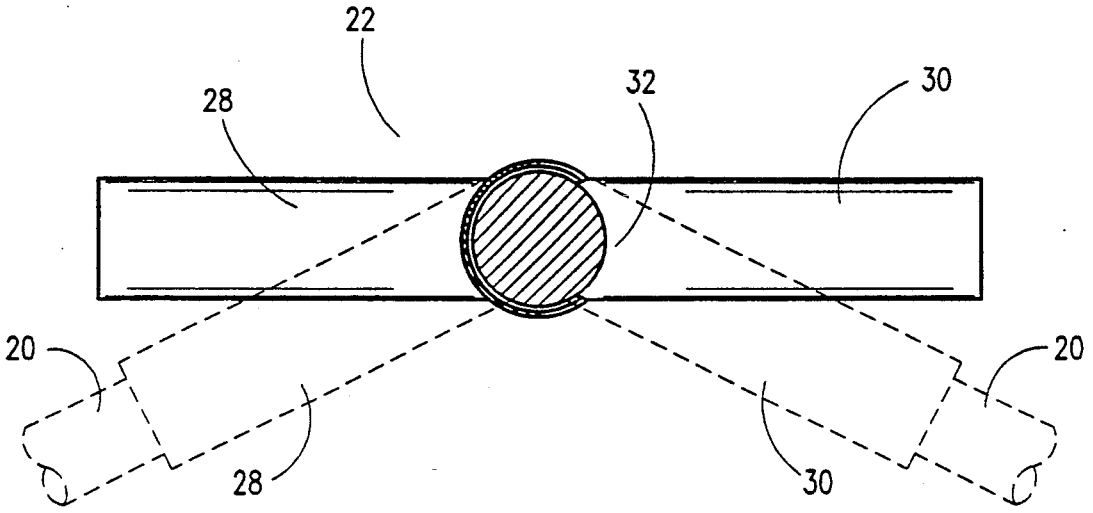
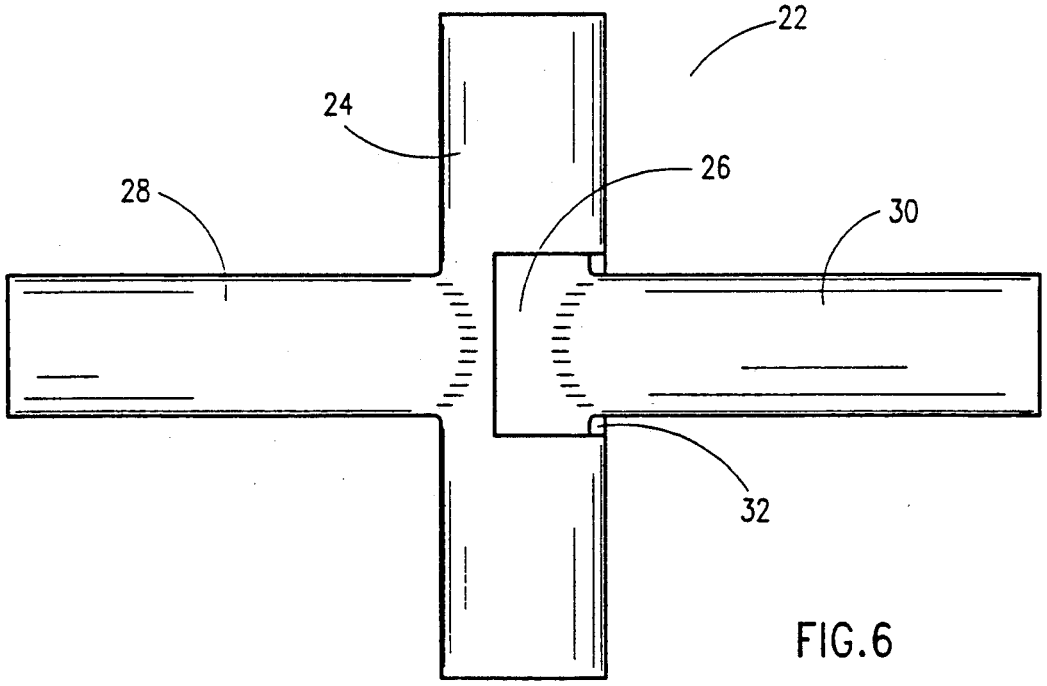
FIG.6

MULTIPURPOSE DRY STORAGE SYSTEM

FIELD AND BACKGROUND OF THE INVENTION

The present invention relates to a dry storage system which can be used to store vehicles or other equipment and, more particularly, to a system for storing vehicles or other equipment for long periods of time which can be easily deployed and redeployed and which enables the vehicle or equipment to be alternately readily placed into, and taken out of storage.

It is often desirable for various reasons to be able to store vehicles or other equipment for relatively long periods of time while preserving the option of quickly accessing the vehicles or other equipment when necessary. It is essential to control the storage conditions so as to minimize or eliminate any deterioration which would be suffered by the vehicle or equipment if stored in the open.

One method of storing vehicles or equipment is to construct a warehouse into which vehicles or other equipment to be stored can be driven or otherwise placed. Since a warehouse is a permanent and rigid structure, it suffers from a number of disadvantage.

First, the size and shape of the warehouse, once it is designed and built, are fixed. It is generally difficult and expensive to add additional warehouse space to an existing warehouse should the existing structure prove inadequate for the required service. Similarly, it is wasteful to under-utilize a warehouse which proves to have been over-designed relative to the actual use.

Second, a warehouse, as a permanent structure, cannot be easily moved, should it be later determined that its original location is, for some reason, no longer optimal. In the most typical case a warehouse may not be moved at all.

Third, in the event of a fire, explosion, or similar catastrophe, it is likely, because of the close proximity of the stored items, that a large number or portion of the vehicles or other equipment stored in the warehouse will be adversely affected.

It has been recognized that there is a need for a dry storage system which will overcome the difficulties inherent in a warehouse structure. Specifically, it has been recognized that it would be useful to have a way of storing vehicles and other equipment which could easily and precisely accommodate any number or quantity of vehicles or other equipment, as the numbers and quantities change with time. It has been similarly recognized that it would be desirable to have a dry storage system which could be easily moved and redeployed so that each vehicle or other equipment is always stored in the optimal location whenever desired. It has been additional been recognized that it would be advantageous to have a dry storage system which will ensure that only a single vehicle or piece of equipment will be affected in the event of a fire, an explosion, or other catastrophic event.

In an effort to overcome some of these disadvantages, there has been developed dry storage systems whose key distinguishing feature is that they provide separate storage for each vehicle or piece of equipment. Each individual storage unit typically includes at least two pieces of plastic, fabric, or other covering material—namely, a base member and a covering member. The vehicle or piece of equipment to be stored (hereinafter referred to as "stored item") is placed on an essentially flat the bottom sheet, the base member. The covering member, which is usually a piece of plastic or other material contoured and shaped so as to accommodate the external shape of a specific stored item, is used to cover the top and sides of the stored item. The covering member is subsequently attached to the base member via a zipper or any other convenient means.

To prevent damage to the covering member which would be caused by the action of corners and other sharp edges and protrusions of the stored item, one could first cover the vehicle or equipment with soft materials, such as sponge or padding, prior to covering the stored item with the covering member.

While this system is, in many ways, superior to the fixed warehousing method, the improved system still suffers from a number of disadvantages which reduce its usefulness. Since the covering is in relatively tight contact with the stored item, each type of stored item requires its own, factory produced, custom contoured and manufactured storage system elements. This complicates the storage system since a large variety of dry storage units must be stocked and maintained in order to accommodate a variety of stored items. A secondary disadvantage associated with the relative tightness of the fit of such storage units is the inevitable tearing and general wearing of the cover caused by contact of the cover with sharp edges and protrusions during periodic deployments.

Another disadvantage which affects these systems is related to the fact that putting an item into storage and taking it out of storage is a highly labor-intensive task. The stored item is sometimes first be wrapped with protective material. The item must subsequently be wrapped with a relatively tightly-fitting covering member. Finally, the base and covering members must be closely aligned with each other in order to effectively operate the mechanism, typically a zipper of some type, which serves to join the base and the covering members. A related disadvantage is that because the storage unit is made up of two separate parts, during high winds it is possible that the covering member can be separated from the base member, thereby exposing the stored item. This disadvantage works to effectively limit the height of such a storage system, and thus limits its applicability to the storage of items which are no taller than a certain height, which height for each specific case is determined by the anticipated wind speeds and other factors.

In an attempt to overcome the disadvantage associated with the separate dry storage system described above, which requires that each type of stored item have its own specially shaped storage unit, there has been developed at least one dry storage system in the form of a tunnel, so that it is capable of accommodating a large variety of stored items. The presently known dry storage tunnel is made of up of two parts—a base member and a covering member. The skeleton of the tunnel is made up of a series of fiberglass poles, each bent into a semi-circle to give the structure its shape. Because of the one-piece construction of each pole, the maximum height of the dry storage structure is limited to approximately 2.6 meters, which is adequate for small items such as motors and aircraft engines, but not sufficiently tall to accommodate most vehicles and other large equipment. In addition, the use of a two-piece construction for the covering makes the entire dry storage unit more difficult to use and relatively unstable.

There is thus a widely recognized need for a dry storage system which will facilitate the storing of a varying number or quantity of stored items of different types, which would be easily movable and redeployable so that each stored item is always stored in the optimal location, which will ensure that only a single or small number of stored items will be affected in the event of a fire or explosion, and which can accommodate the ready and quick putting into storage or the release from storage of the store items.

SUMMARY OF THE INVENTION

According to the present invention there is provided a dry storage unit for use in storing an item, comprising: (a) a tubular protective member made of a flexible material; and (b) support elements capable of giving said protective member its desired shape, each of the support elements includes a pair of support members detachably connected to each other and to an adjoining support element through a connecting member.

According to further features of preferred embodiments of the invention described below, the protective member may be made of any convenient flexible material, such as any one or combination of a variety of fibers and plastics, including, but not limited to, polyvinyl chloride, rubber, synthetic rubber and, preferably, light weight polyurethane. The protective member features a door at one or both of its ends to allow and facilitate the entry and exit of the stored item into and out of the storage unit. The door or doors may be closed using an appropriate fastener, such as an extruded multi-track plastic fastener.

According to still further features in the described preferred embodiment there are provided two or more support elements, each of which may include a pair of semi-rigid poles, made of fiberglass, for example, the support members being capable of being connected to each other and to an adjoining support element through a connecting member. The connecting member can include two cylindrical sections, placed one within the other. Onto each section is attached a transversely oriented member capable of detachably connecting to one of the pair of poles. The transversely oriented member attached to the inner section is mounted onto the inner cylindrical section through an opening in the wall of the outer cylindrical section.

In other features of embodiments according to the present invention there is provided a de-humidifier or other climate control system to control the relative humidity or other condition inside the storage unit.

The present invention successfully addresses the shortcomings of the presently known configurations by providing a dry storage unit which facilitates the storing in a ready state of a varying number or quantity of stored items of different types, which unit is easily movable and redeployable, can readily and quickly store or release from storage the stored items, and which will ensure that only one or a small number of stored items will be affected in the event of a fire or explosion.

A dry storage unit according to the present invention uses a single sheet of flexible protective sheeting material. The protective sheeting is arranged to form a tube. Such a monolithic construction serves to greatly reduce the chance of exposing the stored items to the outside elements, such as dust and moisture.

The tubular protective member is given its appropriate shape by a number of structural members made up of pairs of semi-rigid poles in contact with the tubular member. Each pair of poles is connected together in such a way as to force the flexing of the structural member, thereby effecting the stretching of the protective member and giving it the appropriate shape.

The unit is shaped so as to surround the stored item without contacting the item directly, except for the base portion of the tubular member on which the stored item is placed. Because of this the unit can accommodate stored items of a large variety of shapes and sizes.

To deploy the unit, the tubular member, which is folded or rolled up prior to deployment, is spread out on the ground. The supporting members are then installed giving the unit its shape. Provisions are made for strengthening the base portion of the unit, and for connecting a dehumidifier or other climate control system, where desired, completing the deployment of the unit.

To use the deployed unit for storing an item, a door at one end of the protective member is opened, typically by undoing a fastener. The stored item is driven or otherwise placed onto the base portion of the unit. The door is then refastened shut and, when desired, the dehumidification system, or other climate control system, is activated.

BRIEF DESCRIPTION OF THE DRAWINGS

The invention is herein described, by way of example only, with reference to the accompanying drawings, wherein:

FIG. 6 is a plan view of a connecting member of the type which can be used in conjunction with a unit according to the present invention;

FIG. 7 is an end view of a connecting member of FIG. 6.

DESCRIPTION OF THE PREFERRED EMBODIMENTS

The present invention is of a multipurpose dry storage unit which can effectively and easily be used to store vehicles or other equipment in a ready state for long periods of time, greatly reducing or eliminating the need to maintain the stored items.

The principles and workings of a multipurpose dry storage unit according to the present invention may be better understood with reference to the drawings.

Figure 1:
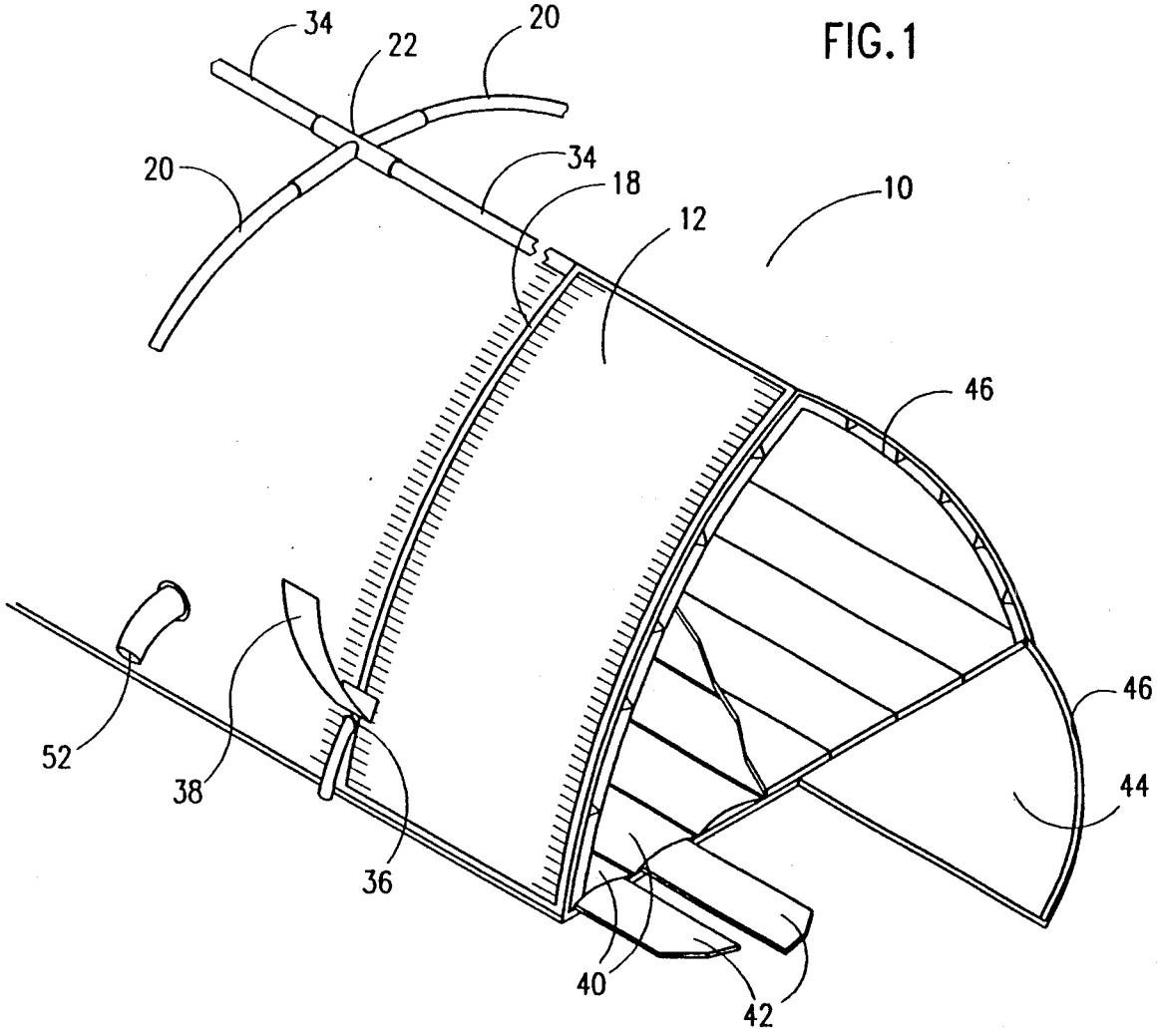
FIG. 1 is a perspective drawing of a portion of a dry storage unit according to the present invention, showing a number of features in cutaway view.

Referring now to the drawings, FIG. 1 illustrates a dry storage unit according to the present invention, designated generally as 10. Other configurations are possible. The configuration discussed below and illustrated in the drawings is offered for illustrative purposes only and is not intended to in any way limit the scope of the present invention. Unit 10 is made up primarily of a tubular protective member 12 and of a number of support elements 18.

Protective member 12 may be of any convenient flexible material which will last under the circumstances and which will adequately protect the stored items. Possible materials include various fabrics and fibers, such as tarpaulin, and any of a large variety of polymeric materials, such as polyvinyl chloride (PVC) or, preferably, light weight polyurethane sheeting. Light weight polyurethane sheeting is one of a number of materials having the capability of functioning adequately over very wide ranges in temperature and relative humidity. The selection of the optimal material of construction for protective member 12 in a particular application depends on the climate or climate or climates of the location or locations where the unit is to be deployed and on the anticipated field conditions.

Figure 4:
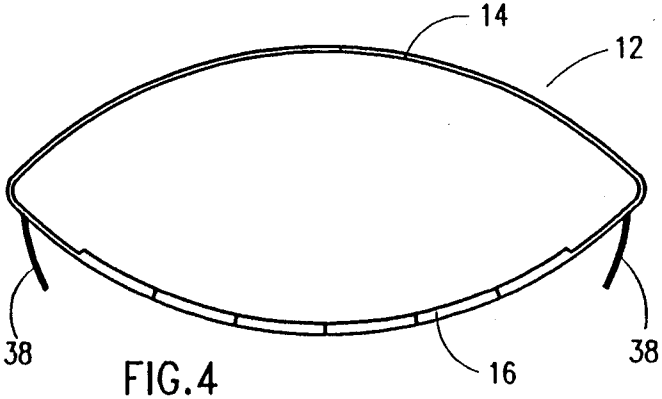
FIG. 4 is an end view of the covering member prior to the installation of the support elements.

Protective member 12 may be directly fabricated in the form of a tube or, more typically, it may be formed of one or more sheets of material which are tightly and permanently or semi-permanently connected to each other to form a tubular shape. The connection of the sheet or sheets to form a cylindrical shape can be effected by any convenient means. For example, fabric sheets may be sewn together while plastic sheets may be connected via adhesives or various heat treatments, including heat curing. Alternatively, the sheets may be connected to each other with appropriate fasteners to facilitate the economical replacement of damaged portions of the unit. The tubular configuration of protective member 12 is shown in FIG. 4, which indicates an upper covering portion 14 and a lower base portion 16.

To deploy a dry storage unit according to the present invention, protective member 12, which is kept in a rolled or folded condition prior to deployment in order to minimize the space taken up by the undeployed unit, is first unrolled or unfolded on the ground, or on an area on which it is desired to erect unit 10. In the unrolled or unfolded condition, protective member 12 appears approximately as it does in FIG. 4 but with covering portion 14 lying directly on top of and in contact with a flattened base portion 16.

Support elements 18 are inserted inside protective member 12 to give protective member 12 its required shape. Each of support elements 18 is made up of a number of subcomponents which are illustrated in FIGS. 1, 6 and 7. Each support element 18 includes a pair of poles 20. Poles 20 can be made of any convenient semi-rigid material. Poles 20 may be hollow but are preferably solid. Poles 20 may be of any convenient cross-sectional shape, preferably circular. Poles 20 are made of a material and thickness such that they are straight when not under force but can be slightly bent, or flexed, when force is applied to them, as during installation. Materials which can be used for poles 20 include various metals, but is preferably fiberglass.

Each pole 20 is connected to another pole 20 to form a pair of poles. The connection of poles 20 is achieved through a connecting member, designated generally as 22. Connecting member 22 is designed to keep poles 20 flexed, when installed in unit 10 so as to give protective member 12 the proper shape. The workings of connecting member 22 can be better appreciated with reference to FIGS. 6 and 7.

Connecting member 22 is primarily made up of two cylindrical sections—a hollow outer cylindrical section 24 and an inner cylindrical section 26 which may be hollow or solid. Connected to outer cylindrical section 24 is a first attachment member 28 oriented substantially perpendicular to the axis of outer cylindrical section 24. The connection between first attachment member 28 and outer cylindrical section 24 may be effected by any convenient means, preferably the two pieces are permanently welded together.

Outer cylindrical section 24 features an opening 32 in its wall. Inner cylindrical section 26 is inserted inside outer cylindrical section 24. Connected to inner cylindrical section 26 is a second attachment member 30 oriented substantially perpendicular to the axis of inner cylindrical section 26. The connection between second attachment member 30 and inner cylindrical section 26 may be effected by any convenient means, preferably the two pieces are permanently welded together. This connection is effected while second attachment member 30 is projecting through opening 32 in outer cylindrical section 24.

One or both ends of hollow cylindrical section 24 is or are capable of detachably connecting to a cross-pole 34 used for connecting adjacent support elements 18. To this end, it may be desirable to have inner cylindrical section 26 be sufficiently shorter than outer cylindrical section 24 so as to permit the insertion of cross-pole 34 into outer cylindrical section 24 thereby effecting the connection of adjacent support elements 18.

Opening 34 in outer cylindrical member 24 is sufficiently large in the axial direction to easily accommodate radial movements of second attachment member 30 with little or no contact between outer cylindrical member 24 second attachment member 30. Opening 34 is sufficiently large in the radial direction to accommodate a certain amount of radial movements of second attachment member 30. It is the ability to accommodate some radial movement of second attachment member 30 relative to first attachment member 30 which gives connecting member 22 the flexibility to hold poles 20 in the proper orientation.

During installation of support elements 18, a pole 20 is inserted through a pole opening 36 in protective member 12 and through a pole sleeve (not shown) which is attached to the inside surface of protective member 12 and which extends from pole opening 36 to a point near the apex of unit 10. Pole openings 36 are covered by flaps 38 which loosely cover pole openings 36 and tend to prevent the entry of dust or moisture into unit 10.

The upper ends of a pair of opposing poles 20 which had been inserted through their respective pole sleeves can be inserted into first and second attachment members, 28 and 30, of connecting member 22. First and second attachment members, 28 and 30, can be rotated relative to each other so as to facilitate the connection of poles 20. Since the radial extent of opening 32 is limited, first and second attachment members, 28 and 30, are prevented from rotating sufficiently relative to each other to allow poles 20 to remain straight. Rather, poles 20 are forced to bend under tension and, because poles 20 are connected to protective element 12 by virtue of their insertion through pole sleeves, bent poles 20 impart to unit 10 its characteristic shape.

The lower ends of poles 20, which exit protective element 12 through pole holes 36, can be implanted into the ground, where this is feasible. Where unit 10 is installed on concrete or another hard surface, it may be desired to implant poles 20 into one or more spacers or templates (not shown) placed outside unit 10 and running along the sides of unit 10. Spacers or templates feature properly spaced holes capable of accommodating the lower ends of poles 20 and serve to ensure the proper spacing and anchoring of poles 20.

Each support element 18 can be attached to the adjacent support element or elements 18 (depending on whether the support element in question is an end element) using cross-pole 34 to give the entire structure added stability. Additional stability may be achieved by separately tying the apices of unit 10, both at the front and at the rear to the ground using guide wires (not shown).

Once unit 10 has been supported so as force it to assume its proper upper configuration, the base may be finished. Protective member includes base portion 16 which features a series of baseboard pockets 40, of a convenient width, such as 80 or 120 cm, into each of which may be inserted an appropriately dimensioned baseboard 42. The purpose of baseboard 42 is to give the base of unit 10 sufficient strength to be able to support the weight of the stored item. Baseboard 42 may be made of any convenient material, such as plywood or plastic. Baseboard 42 may additionally be coated on one or both sides with a soft spongy material such as polystyrene foam.

It may be desirable to place additional baseboards (not shown) on top of base portion 16 in order to reduce or eliminate the possibility of tearing protective member 12, for example by the action of steel treads in the case of the storage of treaded vehicles.

Figure 3:
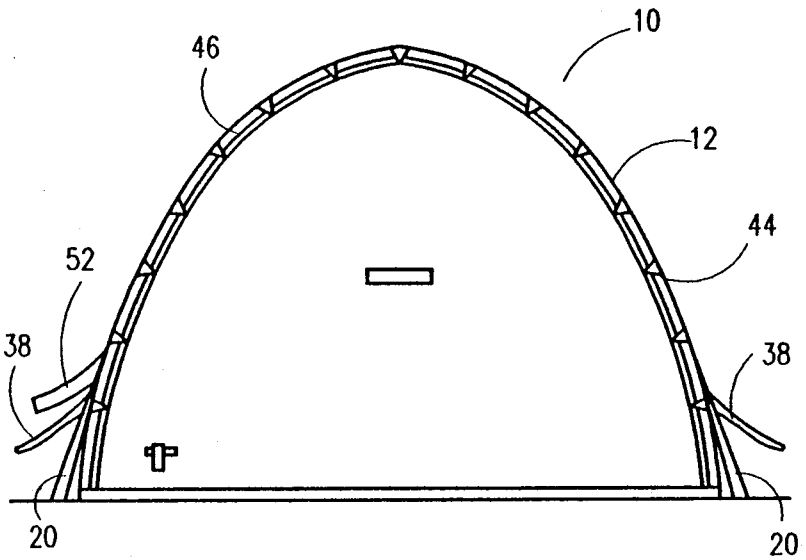
FIG. 3 is an end view of a dry storage unit according to the present invention.
Figure 2:
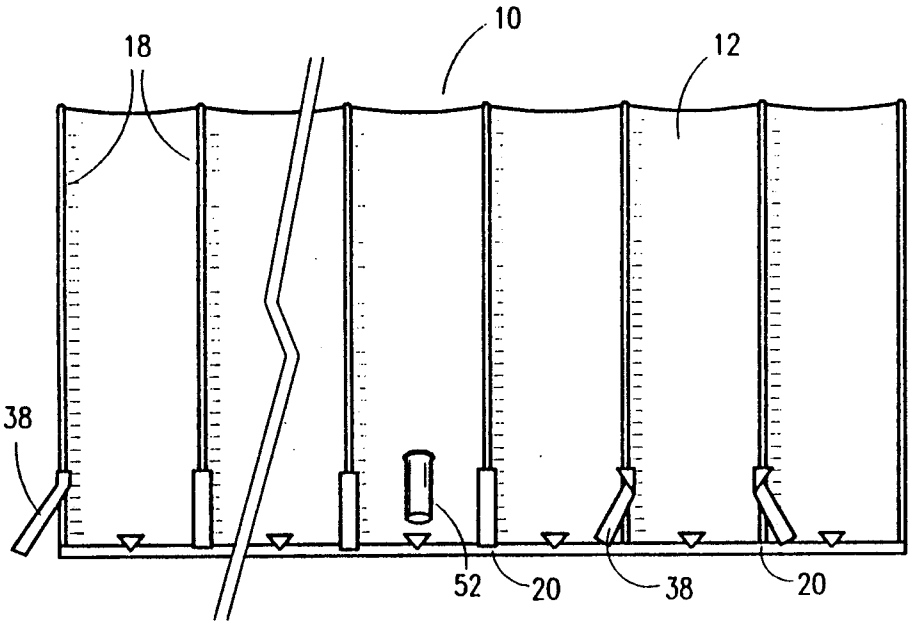
FIG. 2 is a side view of a dry storage unit according to the present invention.

Unit 10 features a door 44 at one end to facilitate the entry and exit of stored items. Preferably unit 10 features a pair of doors 44, one at each end of unit 10. Door 44 can be seen in the closed position in FIG. 3. One half of one door 44 in the open position is shown in cutaway view in FIG. 1. Door 44 may be attached to unit 10 in any convenient fashion. Preferably, door 44 is permanently connected to base portion 16 of protective member 12, as by sewing or by use of adhesives. Preferably, door 44 is detachably connected to covering portion 14 of protective member 12, by use of a fastener 46 of appropriate design, including, but not limited, any of a large variety of zippers.

Figure 5:
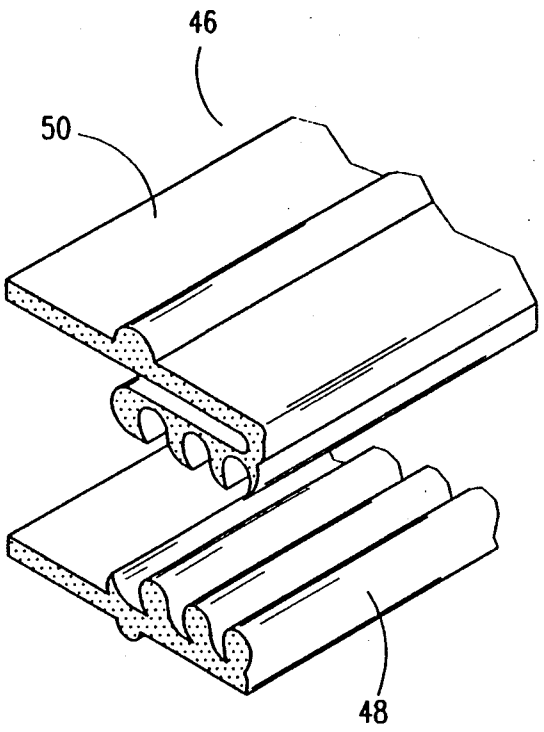
FIG. 5 is a view of an extruded multi-track plastic fastener.

Fastener 46 is preferably of the extruded multi-track plastic fastener type. Such a design is capable of hermetically interlocking, thereby virtually eliminating the possibility that dust or moisture will be able to enter unit 10 at through the fastener 46. A typical three-track plastic fastener is shown in FIG. 5. Fastener 46 is made up of two members—a tracked member 48 and an untracked member 50. One of members 48 or 50 is permanently attached to protective member 12 while the other is permanently attached to door 44. Fastener 46 may be closed by hand or with the aid of an appropriate device, such as a cammed roller slider.

Optionally, unit 10 may include means for controlling the atmosphere inside unit 10 so as to optimize the conditions for long and relatively maintenance-free storage of the stored items. Such means may include heating facilities for storage in cold climates, or dehumidification means, for example, air compression facilities or desiccants, to remove moisture from the air, capable of controlling the relative humidity inside unit 10. Unit 10 may feature one or more protected openings 52 capable of accommodating piping and other connections associated with a climate control system.

Because of the convenient shape of unit 10 it may, when desired, be used as a tent for the housing of personnel rather than, or in addition to, the storage of vehicles or other equipment. Such use may be made with or without the activation of any climate control systems which may be present.

While the invention has been described with respect to one preferred embodiment, it will be appreciated that many variations, modifications and other applications of the invention may be made.

What is claimed is:

1. A dry storage unit for use in storing an item, comprising:

(a) a tubular protective member made of a flexible material; and (b) support elements capable of giving said protective member its desired shape, each of said support elements including a pair of support members detachably connected to each other and to an adjoining support element through a connecting member, said connecting member including:

(i) a first cylindrical section capable of detachably connecting at one or both of its axial ends to an adjoining connecting member or other connecting device, said first cylindrical section having an opening on its wall;

(ii) a transversely oriented first attachment member attached to said first cylindrical section, said first attachment member capable of detachably connecting to one of said pair of support members;

(iii) a second cylindrical section of smaller outer diameter than the inner diameter of said first cylindrical section, said second cylindrical section being rotatably mounted inside said first cylindrical section; and (iv) a transversely oriented second attachment member attached to said second cylindrical section at a point corresponding to said opening in said first cylindrical section, said second attachment member capable of detachably connecting to the one of said pair of support members.

2. A unit as in claim 1 wherein said flexible material is made of polyurethane.

3. A unit as in claim 1 wherein said flexible material is made of rubber.

4. A unit as in claim 1 wherein said flexible material is made of polyvinyl chloride.

5. A unit as in claim 1 wherein said tubular member includes a door at one of its ends.

6. A unit as in claim 5 wherein said door can be closed by attaching to said tubular member using a fastener.

7. A unit as in claim 6 wherein said fastener is an extruded multi-track plastic fastener.

8. A unit as in claim 1 wherein said support members are made of fiberglass.

9. A unit as in claim 1 further including a dehumidifier.

* * * * *